US005251754A

United States Patent [19]

Carter

[11] Patent Number: 5,251,754

[45] Date of Patent: Oct. 12, 1993

[54] CARD SPACER APPARATUS

[76] Inventor: James S. Carter, 6632 Clybourn Ave. #141, N. Hollywood, Calif. 91606

[21] Appl. No.: 981,085

[22] Filed: Nov. 24, 1992

[51] Int. Cl.[5] ..... B65D 81/02

[52] U.S. Cl. ..... 206/449; 206/455; 206/522; 206/814

[58] Field of Search ..... 206/449, 455, 456, 522, 206/556, 591, 594, 814

[56] References Cited

U.S. PATENT DOCUMENTS

| | | | |
|---|---|---|---|
| 344,489 | 6/1886 | McLane | 206/449 |
| 1,795,613 | 3/1931 | Moehle | 206/591 |
| 2,951,608 | 9/1960 | Morrison | 206/522 |
| 2,965,371 | 12/1960 | Gulardo | 206/591 |
| 3,951,730 | 4/1976 | Wennberg et al. | 206/814 |
| 3,980,221 | 9/1976 | Okada | 206/591 |
| 4,120,443 | 10/1978 | Gardner et al. | 206/814 |
| 5,022,527 | 6/1991 | Braeutigam | 206/814 |
| 5,152,647 | 10/1992 | Sewell | 206/814 |

*Primary Examiner*—Jimmy G. Foster
*Attorney, Agent, or Firm*—Leon Gilden

[57] ABSTRACT

First and second abutments are arranged in a biased spaced relationship relative to one another within a container to provide for the packing and densifying of a plurality of card plates and the like within the container to prevent haphazard positioning of the cards within the container structure.

5 Claims, 4 Drawing Sheets

CARD SPACER APPARATUS

BACKGROUND OF THE INVENTION

1. Field of the Invention

The invention relates to a storage apparatus and more specifically to a stacking structure within a container.

2. Description of the Prior Art

Various protective devices for mounting baseball cards and the like have been provided and exemplified in U.S. Pat. Nos. 4,322,001 and 4,979,619. The U.S. Pat. No. 4,949,484 indicates a housing arranged for the compartmentalized storage of cards therewithin.

The instant invention attempts to overcome deficiencies of the prior art by providing for an apparatus to effect densifying of cards within a compartment container to provide for ease of storage and prevent marring of the card structure and in this respect, the present invention substantially fulfills this need.

SUMMARY OF THE INVENTION

In view of the foregoing disadvantages inherent in the known types of card storage apparatus now present in the prior art, the present invention provides a card spacer apparatus wherein the same is arranged for the densifying and packing of cards within a container. As such, the general purpose of the present invention, which will be described subsequently in greater detail, is to provide a new and improved card spacer apparatus which has all the advantages of the prior art card storage apparatus and none of the disadvantages.

To attain this, the present invention provides first and second abutments arranged in a biased spaced relationship to one another within a container to provide for the packing and densifying of a plurality of card plates and the like within the container to prevent haphazard positioning of the cards within the container structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved card spacer apparatus which has all the advantages of the prior art card storage apparatus and none of the disadvantages.

It is another object of the present invention to provide a new and improved card spacer apparatus which may be easily and efficiently manufactured and marketed.

It is a further object of the present invention to provide a new and improved card spacer apparatus which is of a durable and reliable construction.

An even further object of the present invention is to provide a new and improved card spacer apparatus which is susceptible of a low cost of manufacture with regard to both materials and labor, and which accordingly is then susceptible of low prices of sale to the consuming public, thereby making such card spacer apparatus economically available to the buying public.

Still yet another object of the present invention is to provide a new and improved card spacer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
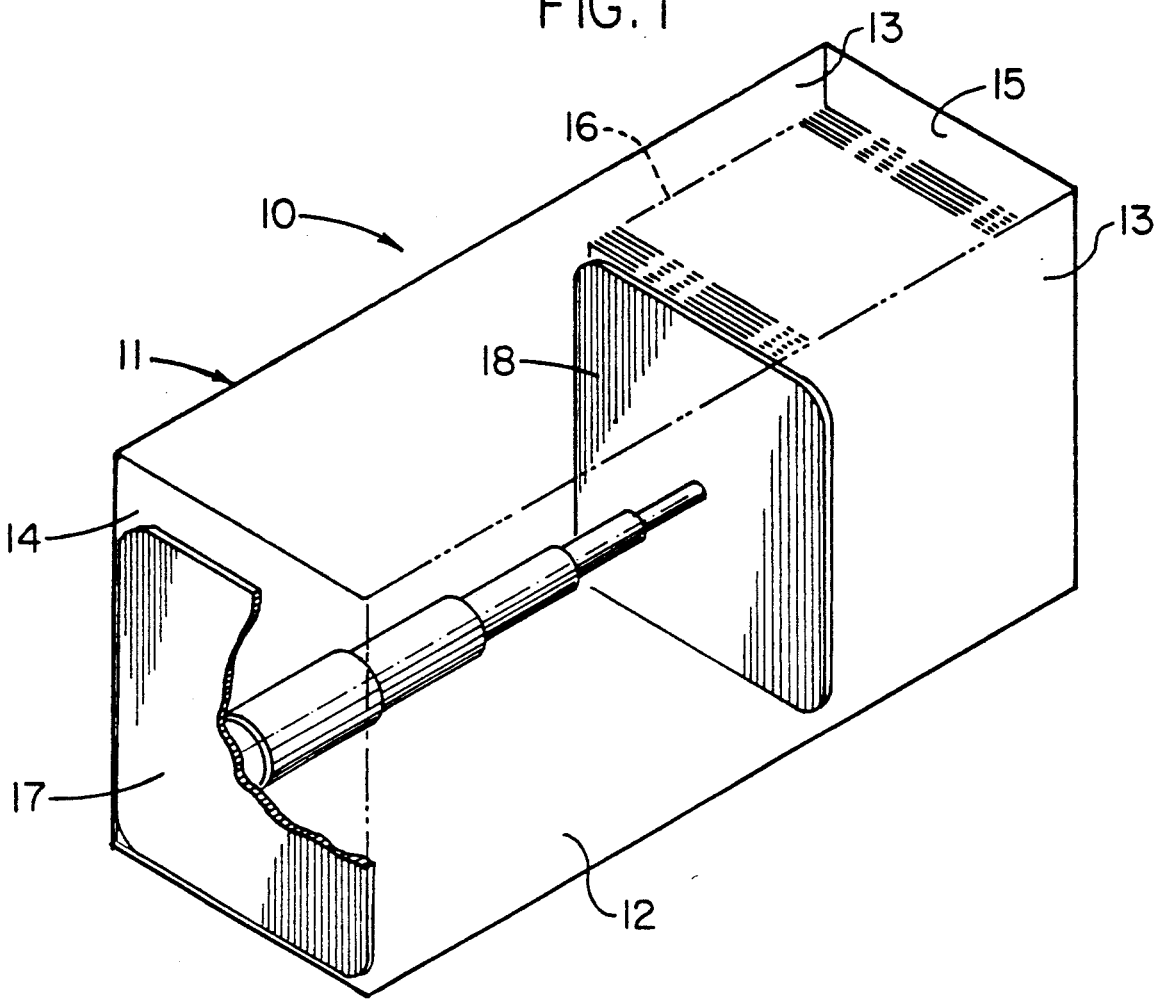
FIG. 1 is an isometric illustration of the invention.
Figure 2:
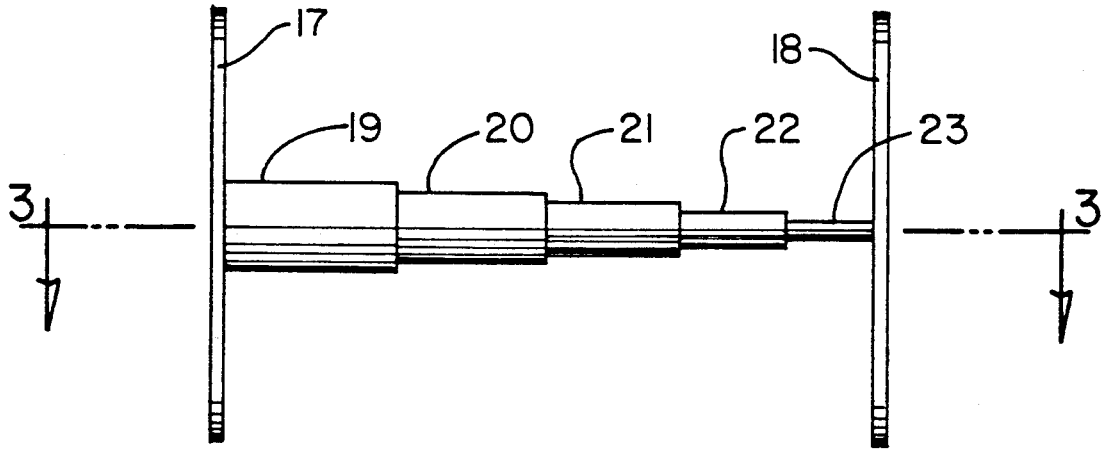
FIG. 2 is an orthographic side view of the spacing structure of the invention.

With reference now to the drawings, and in particular to FIGS. 1 to 9 thereof, a new and improved card spacer apparatus embodying the principles and concepts of the present invention and generally designated by the reference numeral 10 will be described.

More specifically, the card spacer apparatus 10, as indicated in FIG. 1, is mounted within an associated container 11 having a floor 12, spaced side walls 13, a first end wall 14, and a second end wall 15, with a plurality of card plates 16 mounted within the container arranged in a stacked relationship. To minimize the abrasive contact of the cards when in loosely positioned contact relative to one another within the container 11, an abutment structure is included to include a first abutment plate 17 arranged for engagement with the first end wall 14, and the first abutment plate 17 arranged in a biased spaced relationship relative to a second abutment plate 18 arranged for engagement with the card plate 16. Medially and orthogonally directed between the first and second abutment plates 17 and 18 are respective first, second, third, fourth, and fifth tubes 19, 20, 21, 22, and 23 respectively. The second tube 20 is telescopingly received within the first tube 19, the third tube 21 is telescopingly received within the second tube 20, the fourth tube 22 is telescopingly received within the third tube 21, and the fifth tube 23 is telescopingly received within the fourth tube 22. The tubes as illustrated are coaxially aligned relative to one another and arranged for a biased extended relationship relative to one another in a first position and collapsed to a second position, wherein the tubes are arranged for a nested relationship when received within one another.

Figure 3:
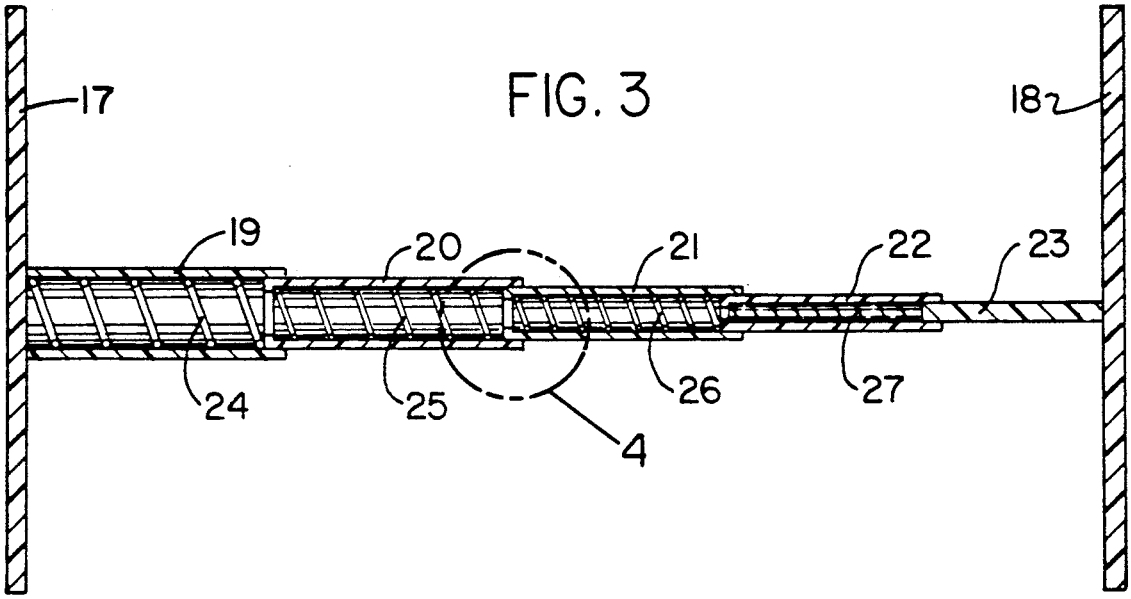
FIG. 3 is an orthographic view, taken along the lines 3—3 of FIG. 2 in the direction indicated by the arrows.
Figure 4:
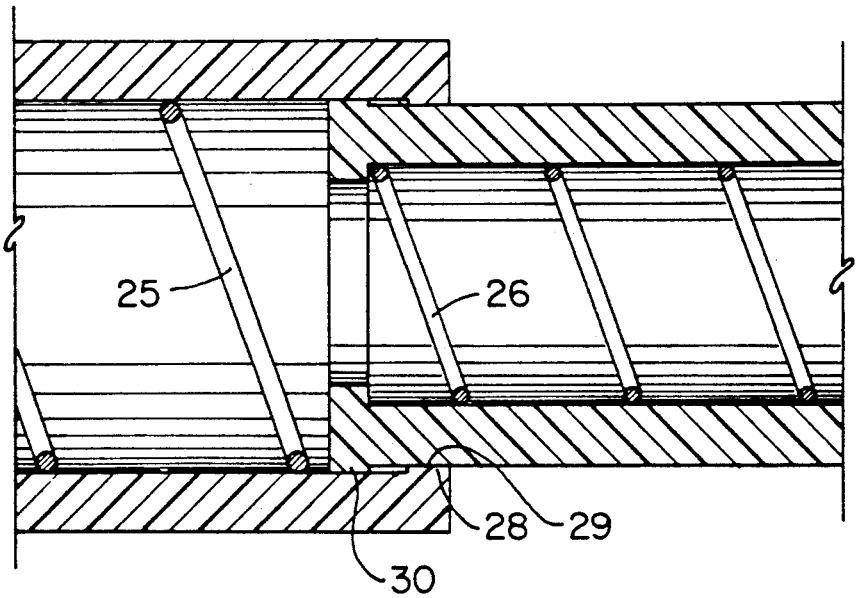
FIG. 4 is an enlarged orthographic view of section 4 as set forth in FIG. 3.

The FIGS. 3 and 4 indicate a manner of providing biased extension of the tubes 19 through 23 relative to one another, wherein the first tube has a second end fixedly, orthogonally, and medially secured to the first abutment plate 17, and a first end including a first annular flange 28 positioned at the first end within the first end, having a first end wall bore 29 directed medially of the first annular flange 28. Further, each first end of the tubes 19, 20, 21, and 22 include a first annular flange 28, as indicated in FIG. 4, having a first end wall bore 29 directed medially thereof coaxially aligned with the tube structure. The tubes 20, 21, 22, and 23 include a second end flange 30 at each respective second end of each of the aforenoted tubes arranged for abutment with a corresponding first annular flange 28, and with a spring interposed between the second end flange 30 of a telescopingly received tube to bias the telescopingly received tube and its associated second end flange 30 into biased engagement with the first annular flange 28 to provide for biased extension of the tubes relative to one another.

Figure 5:
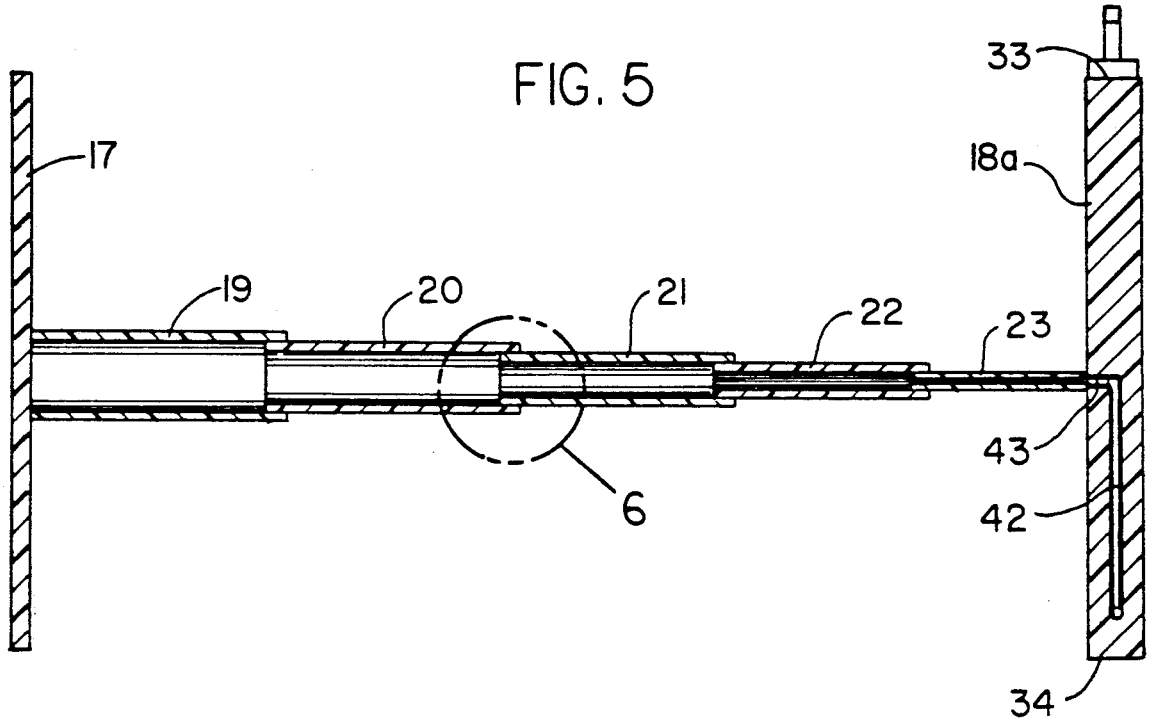
FIG. 5 is an orthographic cross-sectional illustration of a modified stacking structure of the invention.
Figure 6:
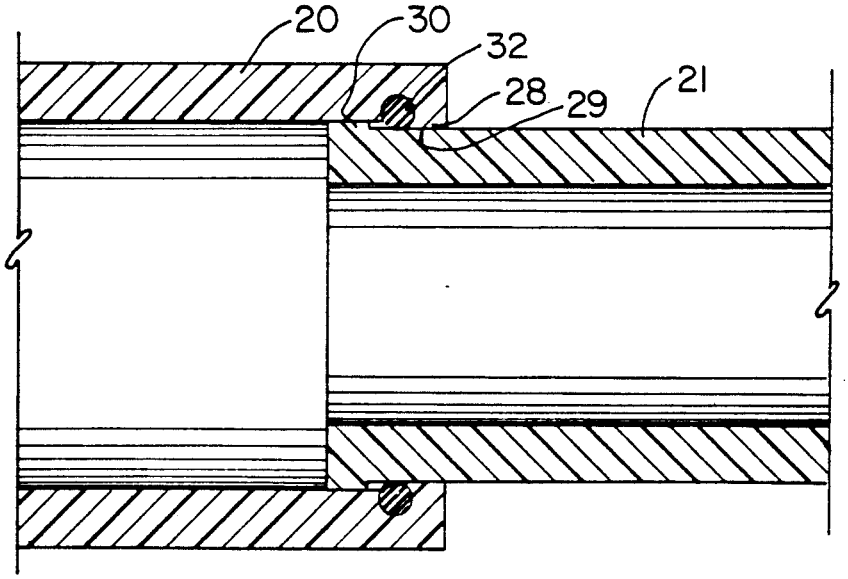
FIG. 6 is an enlarged orthographic view of section 6 as set forth in FIG. 5.
Figure 7:
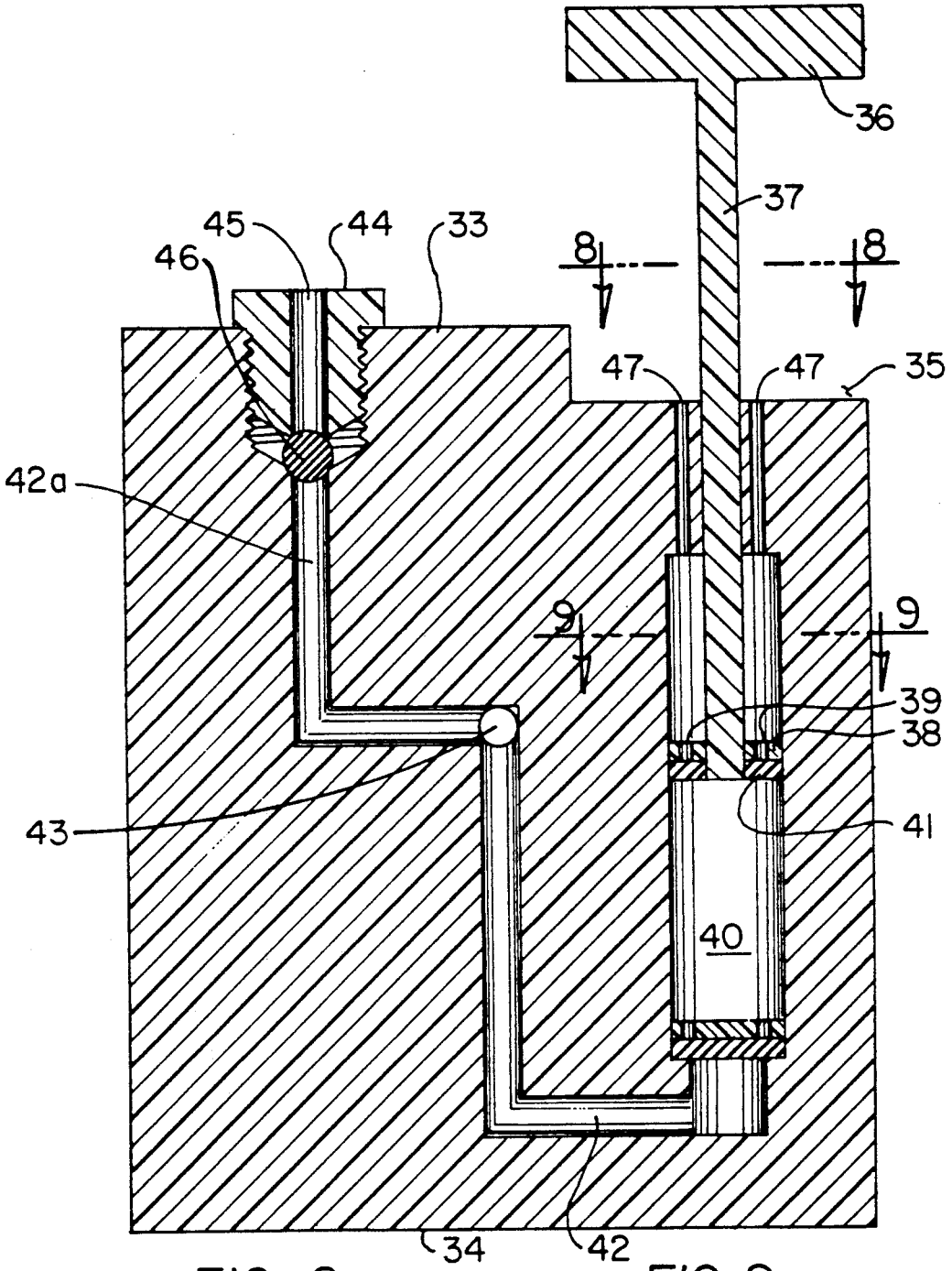
FIG. 7 is an enlarged cross-sectional illustration of the second abutment plate structure of the invention.
Figure 8:
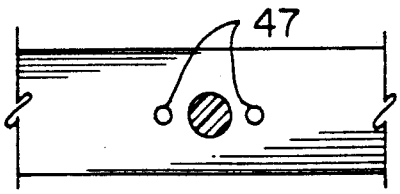
FIG. 8 is an orthographic view, taken along the lines 8—8 of FIG. 7 in the direction indicated by the arrows.
Figure 9:
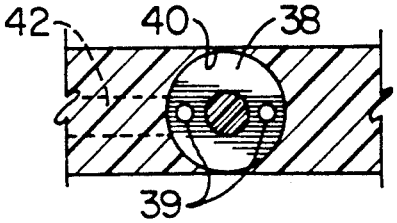
FIG. 9 is an orthographic view, taken along the lines 9—9 of FIG. 7 in the direction indicated by the arrows.

The FIG. 5 provides for an alternative manner of biasing the tubes relative to one another utilizing pneumatic pressure, wherein the respective first and second annular flanges are biased to one another by pneumatic pressure from the use of a modified second abutment plate 18*a*. The first through fifth tubes 19–23 respectively are each in pneumatic communication relative to one another and to a second pneumatic conduit 43 of the second abutment plate 18*a*, that in turn is in pneumatic communication with the first pneumatic conduit 42, that in turn is in pneumatic communication with a pneumatic cylinder 40 within the second abutment plate 18*a*. Reference to FIG. 7 indicates the modified second abutment plate 18*a* having a top wall 33 spaced from a bottom wall 44, with the top wall 33 including a top wall recess 35 having a predetermined depth to receive a handle 36 having a predetermined thickness substantially equal to the predetermined depth to nestingly receive the handle 36 within the recess 35. The handle 36 includes a handle rod 37 orthogonally and medially mounted to the handle 36, with the rod 37 directed into the second abutment plate 18*a*, with the handle rod 37 including a piston 38 mounted to the rod 37 within the pneumatic cylinder 40. The piston 38 includes at least one, and typically a plurality of, piston ports 39 directed through the piston 38. The piston ports 39 are arranged to receive air to be pressurized from inlet ports 47 directed through the top wall recess 35 into communication with the pneumatic cylinder 40 that are below the handle 36. A first flap valve plate 41 is mounted to and below the piston 38, whereupon raising of the piston 38 by means of the rod 37, deflects the flap valve plate 41 from communication with the bottom surface of the piston 38 to permit air directed through the inlet ports 47 and through the piston ports 39 into the pneumatic cylinder 40, whereupon projection of the rod 37 into the pneumatic cylinder 40 compresses air therewithin from the pneumatic cylinder 40 into the first pneumatic conduit 42 and then into the second pneumatic conduit 43 and from there into the first through fifth tubes 19–23. To provide for release of pressure from the tubes 19–23, the first pneumatic conduit 42 extends to the top wall 33, wherein a relief plug 44 is threadedly directed. The relief plug 44 includes a relief plug port 45, with a sealing sphere 46 interposed between the relief plug port 45 and the first pneumatic conduit exit 42*a*. In this manner, loosening of the relief plug 44 within the top wall 33 permits the sealing sphere 46 to be displaced between the relief plug 44 and the exit port 42*a* and thereby permitting excess pressure from within the system to be directed through the relief plug port 44 without completely removing the relief plug 44 from the top wall 33.

As to the manner of usuage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

There, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card spacer apparatus, comprising, a container, the container having a floor, spaced side walls, a first end wall spaced from a second end wall, and an abutment assembly positioned within the container, with the abutment assembly including a first abutment plate in communication with the first end wall within the container, and a second abutment plate arranged in a spaced orientation relative to the first abutment within the container, and biasing means mounted to the first abutment plate and the second abutment plate to bias the first abutment plate relative to the second abutment plate in a spaced relationship, and the biasing means includes a plurality of tube members, wherein the plurality of tube members includes a first tube fixedly and orthogonally mounted medially of the first abutment plate between the first abutment plate and the second abutment plate, and a second tube telescopingly received within the first tube, and a third tube telescopingly received within the second tube, a fourth tube telescopingly received within the third tube, and a fifth tube telescopingly received within the fourth tube, the fifth tube mounted medially and orthogonally of the second abutment plate.

2. An apparatus as set forth in claim 1 wherein the biasing means further includes the first tube having a first tube first annular flange and the second tube having a second tube second annular flange positioned within the first tube for engagement with the first tube first annular flange, and the second tube having a second tube first annular flange, and the third tube having a third tube second annular flange positioned within the second tube for engagement with the second tube first annular flange, and the third tube having a third tube first annular flange, and the fourth tube having a fourth tube second annular flange positioned within the third tube and slidably received through the third tube first annular flange, and the fourth tube having a fourth tube first annular flange receiving the fifth tube therethrough, and the fifth tube having a fifth tube second annular flange for abutment with the fourth tube first annular flange.

3. An apparatus as set forth in claim 2 wherein the biasing means includes a pneumatic pump mounted within the first abutment plate and in pneumatic engagement with the first tube, the second tube, the third tube, the fourth tube, and the fifth tube for biasing the first tube, the second tube, the third tube, the fourth tube, and the fifth tube in a telescoped extended relationship relative to one another.

4. An apparatus as set forth in claim 3 wherein the pneumatic pump includes a pneumatic cylinder positioned within the second abutment plate, the second abutment plate including a top wall spaced from a bottom wall, the top wall having a top wall recess having a predetermined depth and a handle received complementarily within the top wall recess, wherein the handle is formed of a predetermined thickness equal to the predetermined depth, and the handle having a handle rod fixedly mounted to the handle, the handle rod directed into the second abutment plate into the pneumatic cylinder, with the handle rod having a piston mounted to the handle rod within the pneumatic cylinder, and inlet ports directed into the top wall within the recess in pneumatic communication with the pneumatic cylinder, and a resilient flap valve plate mounted to the piston, wherein the piston includes piston conduits directed therethrough in facing relationship relative to the inlet ports and the flap valve plate positioned below the piston conduits, whereupon projecting the handle and the handle rod in an extended orientation relative to the top wall recess deflects the flap valve plate relative to the piston to direct air between the flap valve plate and a first pneumatic conduit in pneumatic communication with the pneumatic cylinder, the first pneumatic conduit in pneumatic communication with a second pneumatic conduit, the second pneumatic conduit directed through the abutment plate extending therefrom in pneumatic communication with the fifth tube.

5. An apparatus as set forth in claim 4 wherein the first pneumatic conduit includes an exit port positioned in adjacency to the top wall, and a relief plug threadedly directed into the top wall, and the relief plug having a relief plug sealing sphere positioned between the relief plug and the exit port, and the relief plug having a relief plug port, whereupon displacement of the relief plug relative to the top wall permits displacement of the sealing sphere relative to the relief plug permitting excess pneumatic pressure to escape through the relief plug port.

* * * * *